US009878185B2

(12) United States Patent
Underwood et al.

(10) Patent No.: US 9,878,185 B2
(45) **Date of Patent: *Jan. 30, 2018**

(54) FLAME RESISTANT FABRIC AND GARMENTS MADE THEREFROM

(71) Applicant: International Textile Group, Inc., Greensboro, NC (US)

(72) Inventors: Joey K. Underwood, Greenville, SC (US); Jacques A. Cantin, Greenville, SC (US); Guy Connors Lucas, Charlotte, NC (US)

(73) Assignee: INTERNATIONAL TEXTILE GROUP, INC., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/163,209

(22) Filed: May 24, 2016

(65) Prior Publication Data

US 2016/0375277 A1 Dec. 29, 2016

Related U.S. Application Data

(63) Continuation of application No. 14/470,615, filed on Aug. 27, 2014, now Pat. No. 9,364,694, which is a (Continued)

(51) Int. Cl.
*A62B 17/00* (2006.01)
*A41D 31/00* (2006.01)
(Continued)

(52) U.S. Cl.
CPC ..... *A62B 17/003* (2013.01); *A41B 1/00* (2013.01); *A41D 1/02* (2013.01); *A41D 1/06* (2013.01);
(Continued)

(58) Field of Classification Search
CPC . D03D 5/12; D03D 1/00; D03D 15/00; A41D 31/0027; A41D 31/0022; A41D 31/02
See application file for complete search history.

(56) References Cited

U.S. PATENT DOCUMENTS 3,019,821 A 11/1955 White
3,729,920 A 5/1973 Sayers et al.
(Continued)

FOREIGN PATENT DOCUMENTS

CN 1659323 8/2005
GB 2516134 1/2015

OTHER PUBLICATIONS

Duralite Fabric Information Including Morning Pride Press Release and Slides, 7 pages.

(Continued)

*Primary Examiner* — Bobby Muromoto, Jr.
(74) *Attorney, Agent, or Firm* — Dority & Manning, PA

(57) ABSTRACT

Protective garments include a flame resistant fabric that is strong and yet has a soft hand. The fabric is made from a combination of filament yarns and spun yarns. The filament yarns and spun yarns are woven together such that the filament yarns are separated by from about 2 to about 5 spun yarns in both the warp direction and the fill direction. The spun yarns may contain polybenzimidazole fibers in combination with other fibers, such as aramid fibers. The filament yarns may comprise para-aramid fibers. In one embodiment, the filament yarns may have a size larger than the spun yarns.

30 Claims, 8 Drawing Sheets

Related U.S. Application Data continuation of application No. 13/436,081, filed on Mar. 30, 2012, now Pat. No. 8,819,866.

(51) Int. Cl.

| | |
|---|---|
| ***D02G 3/44*** | (2006.01) |
| ***D03D 15/12*** | (2006.01) |
| ***A41B 1/00*** | (2006.01) |
| ***A41D 1/02*** | (2006.01) |
| ***A41D 1/06*** | (2006.01) |
| ***A41D 19/015*** | (2006.01) |
| ***A42B 3/00*** | (2006.01) |
| *A41D 13/00* | (2006.01) |

(52) U.S. Cl.

CPC ..... *A41D 19/015* (2013.01); *A41D 31/0022* (2013.01); *A42B 3/00* (2013.01); *D02G 3/443* (2013.01); *D03D 15/12* (2013.01); *D10B 2331/021* (2013.01); *D10B 2331/14* (2013.01); *Y10T 442/3065* (2015.04)

(56) References Cited

U.S. PATENT DOCUMENTS 4,304,811 A 12/1981 David et al.
4,749,378 A * 6/1988 Cates ..... D06P 1/926 8/115.56
4,759,770 A * 7/1988 Cates ..... D06P 1/926 8/130.1
5,299,602 A 4/1994 Barbeau et al.
5,858,888 A * 1/1999 Underwood ..... A41D 31/0027 139/420 A
5,928,971 A 7/1999 Ellis et al.
6,065,153 A * 5/2000 Underwood ..... A41D 27/04 2/93
6,132,476 A * 10/2000 Lunsford ..... D06P 1/6426 442/136
6,192,520 B1 * 2/2001 Underwood ..... A41D 27/04 2/458
6,247,179 B1 * 6/2001 Underwood ..... A41D 31/0027 2/69
6,460,321 B1 10/2002 Koshimae et al.
6,547,835 B1 * 4/2003 Lunsford ..... D06P 1/6426 8/529
6,606,749 B2 * 8/2003 Underwood ..... A41D 27/04 2/87
6,624,096 B2 * 9/2003 Thomas ..... A41D 31/0022 169/45
6,750,162 B2 6/2004 Underwood et al.
6,818,024 B2 * 11/2004 Lunsford ..... D06P 1/6426 442/136
6,867,154 B1 * 3/2005 Lunsford ..... D06P 1/6426 2/458
6,886,184 B2 * 5/2005 Underwood ..... A41D 27/04 2/81
6,974,785 B1 12/2005 Barbeau et al.
7,393,800 B2 7/2008 Corner
7,581,260 B2 * 9/2009 Underwood ..... A41D 27/04 2/81
7,589,036 B2 * 9/2009 Corner ..... A41D 31/0022 442/301
7,811,952 B2 * 10/2010 Truesdale, III ..... D06M 13/127 428/920
7,862,865 B2 1/2011 Truesdale, III et al.
8,071,492 B2 * 12/2011 Hess ..... A41D 31/0022 428/920
8,209,785 B2 * 7/2012 Underwood ..... D02G 3/047 2/272
8,528,120 B2 9/2013 Underwood et al.
8,614,156 B2 12/2013 Hess et al.
8,819,866 B2 * 9/2014 Underwood ..... A41D 31/0022 139/420 A
9,364,694 B2 * 6/2016 Underwood ..... A41D 31/0022
2002/0026663 A1 * 3/2002 Underwood ..... A41D 27/04 2/458
2002/0106955 A1 * 8/2002 Underwood ..... B32B 27/12 442/148
2003/0040240 A1 2/2003 Thomas et al.
2003/0203690 A1 * 10/2003 Hess ..... A41D 31/0022 442/181
2003/0228812 A1 * 12/2003 Stanhope ..... A41D 31/0022 442/49
2003/0228821 A1 12/2003 Zhu et al.
2004/0034905 A1 * 2/2004 Underwood ..... A41D 27/04 2/458
2004/0092187 A1 5/2004 Favier et al.
2004/0152378 A1 8/2004 Stanhope et al.
2005/0155131 A1 * 7/2005 Underwood ..... A41D 27/04 2/85
2005/0158559 A1 * 7/2005 Martin ..... B32B 27/12 428/422
2005/0186875 A1 * 8/2005 Lilani ..... D02G 3/047 442/189
2006/0154542 A1 * 7/2006 Underwood ..... D03D 1/00 442/82
2007/0072502 A1 * 3/2007 Underwood ..... D03D 1/00 442/82
2011/0049949 A1 3/2011 Basmaji et al.
2011/0165807 A1 * 7/2011 Underwood ..... D03D 1/00 442/76
2011/0191949 A1 * 8/2011 Underwood ..... D02G 3/047 2/458
2011/0281097 A1 * 11/2011 Li ..... B06M 15/43 428/219
2012/0270456 A1 10/2012 Gstettner et al.
2012/0278979 A1 * 11/2012 Underwood ..... D02G 3/047 2/455
2013/0008554 A1 1/2013 Fisher et al.
2014/0360619 A1 12/2014 Underwood et al.

OTHER PUBLICATIONS

Safety Components Data Sheet on ARMOR 5.5, one page.
Safety: Components Brochure on ARMOR 7.0, 34 pages.
Extended European Search Report for EP Application No. 12167962.5-2314, dated Dec. 5, 2012.
Properties of Armos Para-Aramid Fibres in Conditions of Use. Comparison with Other Para-Aramids, K.E. Perepelkin et al., Fibre Chemistry, vol. 33, No. 2, 2001 pp. 105-114.
Abstract of JP 2009280942 dated Dec. 3, 2009, 2 pages.
Design U.S. Appl. No. 29/521,529 dated Mar. 24, 2015.
Third party submission filed in U.S. Appl. No. 14/470,615, dated Mar. 9, 2015, 44 pages.
Third party submission filed in U.S. Appl. No. 14/470,615, dated Jul. 31, 2015, 70 pages.

* cited by examiner

FLAME RESISTANT FABRIC AND GARMENTS MADE THEREFROM

RELATED APPLICATIONS

The present application is a continuation of U.S. application Ser. No. 14/470,615, filed on Aug. 27, 2014, which is a continuation of U.S. application Ser. No. 13/436,081, filed on Mar. 30, 2012, now U.S. Pat. No. 8,819,866, all of which are incorporated herein by reference.

BACKGROUND

Various different types of protective garments exist that are intended to provide protection to the wearer. In certain embodiments, for instance, the protective garments are designed to provide protection from heat and flame so as to prevent burn injuries. Such protective garments, for instance, are typically worn by firefighters, other service providers, and military personnel. Military personnel, for instance, wear such garments to provide protection against incendiary devices and the like.

Such garments should be fire resistant while also being as light as possible, strong, abrasion resistant, rip and tear resistant, flexible, and should encumber the wearer as little as possible.

Conventional firefighter garments, for instance, are generally constructed having a number of discrete layers. Typically, these layers include an outer shell, a moisture barrier layer, a thermal barrier layer, and an inner lining. The layers are generally made from appropriate thermally-resistant materials to provide protection against heat and flame.

Protective garments for firefighters that are also water resistant are disclosed in U.S. Pat. No. 7,581,260, which is incorporated herein by reference. The '260 patent discloses various garments and fabrics that have made great advances in the art.

Improvements, however, are still needed in designing fabrics for protective garments that are intended to provide fire resistance. In particular, a need exists for lighter fabrics that provide the same or better physical properties than current commercial products. A need also exists for a fabric that has a soft hand, meaning that the fabric is flexible and easy to maneuver in when worn.

SUMMARY

In general, the present disclosure is directed to flame resistant garments that are made from a flame resistant fabric. The flame resistant garment, for instance, may comprise any protective garment designed to protect a wearer from exposure to heat and/or flame. In one embodiment, for instance, the protective garment may comprise a fireman turnout coat, trousers worn by firemen, or any other garment worn by firefighters. In an alternative embodiment, the garment may comprise apparel worn by military personnel. For instance, the garment may comprise a bomb suit, tank uniform, other combat garments, a flight jacket, or the like. In still another embodiment, the garment may comprise industrial workwear or may comprise a protective chemical suit. The garment may comprise a shirt, a coat, a jacket, trousers, gloves, boots, protective headgear such as a hat, or the like.

In one embodiment, the present disclosure is directed to a flame resistant garment that includes a fabric shaped to cover at least a portion of a wearer's body. The fabric comprises first yarns combined with second yarns. The first yarns comprise filament yarns comprised of an inherently flame resistant material. For instance, the filament yarns may be made from an aramid polymer, such as a para-aramid polymer or a meta-aramid polymer. The second yarns, on the other hand, comprise spun yarns which may contain fibers comprised of polybenzimidazole and fibers comprised of an aramid polymer. In accordance with the present disclosure, the first yarns and the second yarns are contained in the fabric in a ratio of from about 1:1 to about 1:5, such as greater than 1:1 to about 1:5. For instance, in one embodiment, the first and second yarns are contained in the fabric in a ratio of 1:2 such that for every filament yarn there are two spun yarns.

The fabric described above, for instance, may have a warp direction and a fill direction. The ratio between the first yarn and the second yarn can be the same in both the warp and fill direction or may be different between the warp and fill directions. In one particular embodiment, for instance, the ratio of the first yarns to the second yarns in the warp direction and the fill direction is 1:2.

In one embodiment, the spun yarn can contain polybenzimidazole fibers in an amount from about 30% to about 60% by weight, such as in an amount from about 40% to about 55% by weight. The entire fabric, for instance, may contain polybenzimidazole fibers in an amount of at least about 20% by weight, such as in an amount of at least about 25% by weight, such as in an amount of at least about 30% by weight, such as in an amount of at least about 35% by weight, such as in an amount of at least about 40% by weight. Polybenzimidazole fibers are contained in the fabric in an amount generally less than about 70% by weight, such as in an amount less than about 60% by weight, such as in an amount less than about 50% by weight.

The fabric can have any suitable weave depending on the particular application and desired result. For instance, the fabric may have a rip stop weave, a herringbone weave, or a plain weave. In one embodiment, the fabric may have a twill weave.

In one embodiment, the filament yarns can optionally have a bigger size than the spun yarns. As used herein, the size of a yarn refers to its weight per unit length. Thus, when the filament yarns have a denier of 600, the spun yarns have a size of 18/2 or less. When the filament yarns have a denier of 400, on the other hand, the spun yarns can have a size of 27/2 or less. When the filament yarns have a denier of 200, the spun yarns can have a size of 54/2 or less. In general, the spun yarns have a size of 108/2 or greater, such as greater than 70/2 or greater than 60/2.

Of particular advantage, fabrics made according to the present disclosure can have excellent physical properties at relatively light weights. The fabric, for instance, may have a basis weight of less than about 8 osy, such as less than about 7.5 osy, such as less than about 7 osy, such as less than about 6.5 osy, such as less than about 6.0 osy. The basis weight of the fabric is generally greater than about 3 osy, such as greater than about 4 osy, such as greater than about 4.5 osy. In certain embodiments, the basis weight is from about 5.5 osy to about 6.5 osy or from about 6.0 osy to about 7.5 osy. Within the above weight ranges, the fabric can have a circular bend in the warp direction or in the fill direction of from about 2 lbs. to about 5 lbs. when tested according to ASTM Test D4032. The fabric can have a break strength in the fill direction of from about 400 lbs. to about 800 lbs. when tested according to ASTM Test D5034. The fabric can have a trap tear in the warp direction of from about 300 lbs. to about 450 lbs. and can have a trap tear in the fill direction of from about 250 lbs. to about 400 lbs. when tested according to ASTM Test D5587.

The fabric can also have excellent thermal properties. For instance, the fabric may produce a char length of less than about 10 mm when tested according to ASTM Test D6413. Further, the fabric can display the above char lengths even after being laundered five laundry cycles according to AATCC135.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
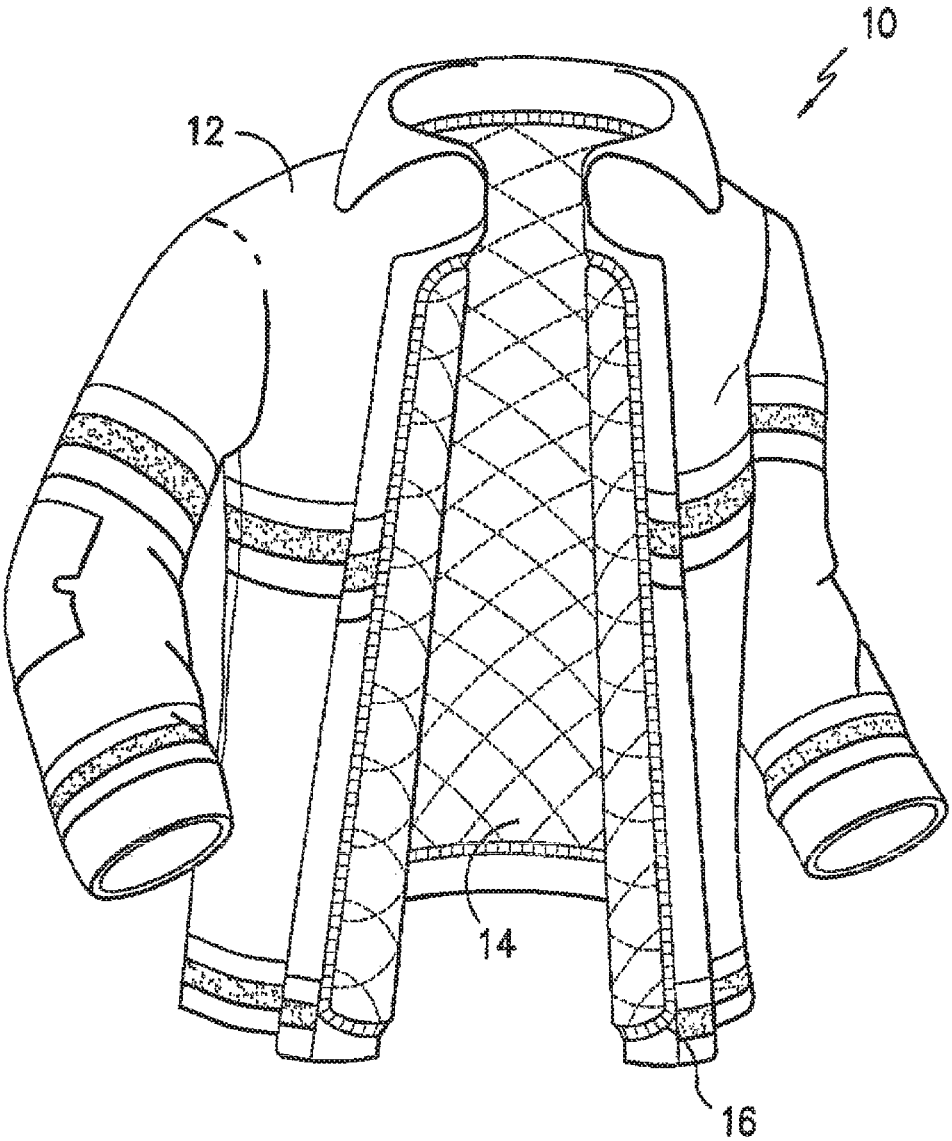
FIG. 1 is a perspective view of one embodiment of a protective garment made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to protective garments that provide heat and flame resistance to a wearer. In accordance with the present disclosure, the protective garments are made from a flame resistant fabric. The fabric includes a combination of filament yarns and spun yarns that are each primarily made from inherently flame resistant materials. The spun yarns contain polybenzimidazole fibers that enhance the flame resistant properties of the fabric.

As will be described in greater detail below, the filament yarns and the spun yarns are woven together in a manner that produces a fabric with excellent physical properties. For instance, the fabric has excellent strength properties in combination with excellent tactile qualities. In particular, the fabric is very strong while also having a soft hand and being very flexible. Of particular advantage, the above characteristics and properties are obtained at relatively low fabric weights. Consequently, garments made from the above described fabric not only provide excellent thermal protection, but are also very comfortable to wear.

Various protective garments may be made in accordance with the present disclosure. The protective garments include, for instance, footwear, trousers, jackets, coats, shirts, headwear, gloves, and the like. The fabric can also be used to construct one-piece jumpsuits, which may be well suited for use in industrial settings.

The garments can be constructed so as to be worn in all types of environments and can be worn by people with different occupations. In one embodiment, the garment may comprise a military garment, such as a battledress uniform. The garment may also comprise various other military apparel, such as flight suits, military jackets, military parkas, and the like.

In one embodiment, the fabric may be used to construct a garment worn by firefighters. For instance, referring to FIG. 1, one embodiment of a fireman turnout coat 10 constructed in accordance with the present disclosure is illustrated. Garment 10 includes a relatively tough outer shell 12 having a liner assembly 14 located therein. Outer shell 12 and liner assembly 14 together function to protect a wearer from heat and flame such as may be encountered during firefighting activities.

In the illustrated embodiment, liner assembly 14 is constructed as a separate unit that may be removed from outer shell 12. A zipper 16 is provided for removably securing liner assembly 14 to outer shell 12. It should be appreciated, however, that other suitable means of attachment, including a more permanent type of attachment such as stitches, may also be used between liner assembly 14 and outer shell 12.

Figure 2:
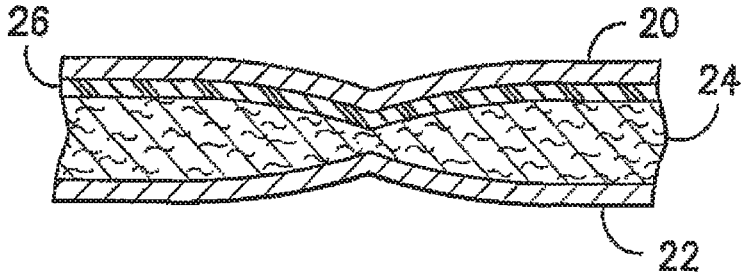
FIG. 2 is a cross-sectional view of the garment illustrated in FIG. 1.

The construction of protective garment 10 is more particularly illustrated in FIG. 2. As shown, liner assembly 14 includes a plurality of material layers quilted together. The outermost layers, i.e. lining layers 20 and 22, are connected together about their respective peripheries to form an inner cavity. A thermal barrier layer 24 and a moisture barrier layer 26 are located within the inner cavity, as shown. Typically, lining layer 20 will be adjacent the wearers body during use, whereas lining layer 22 will be adjacent outer shell 12.

Thermal barrier layer 24 can be made from various materials. For instance, an aramid felt, such as a felt produced from NOMEX fibers obtained from DuPont can be used. The felt functions as an insulator to inhibit transfer of heat from the ambient-environment to the wearer.

Moisture barrier 26 is preferably a suitable polymeric membrane that is impermeable to liquid water but is permeable to water vapor. Moisture barrier layer 26 is designed to prevent water contacting the exterior surface of garment 10 from reaching the wearer while at the same time permitting the escape of perspiration from the wearer.

In the embodiment described above, the fireman turnout coat 10 includes multiple layers. In other embodiments, however, it should be understood that a coat or jacket made in accordance with the present disclosure may include a single layer or may include an outer shell attached to a liner. For example, wildland firefighter garments are typically one or two layers.

Figure 3:
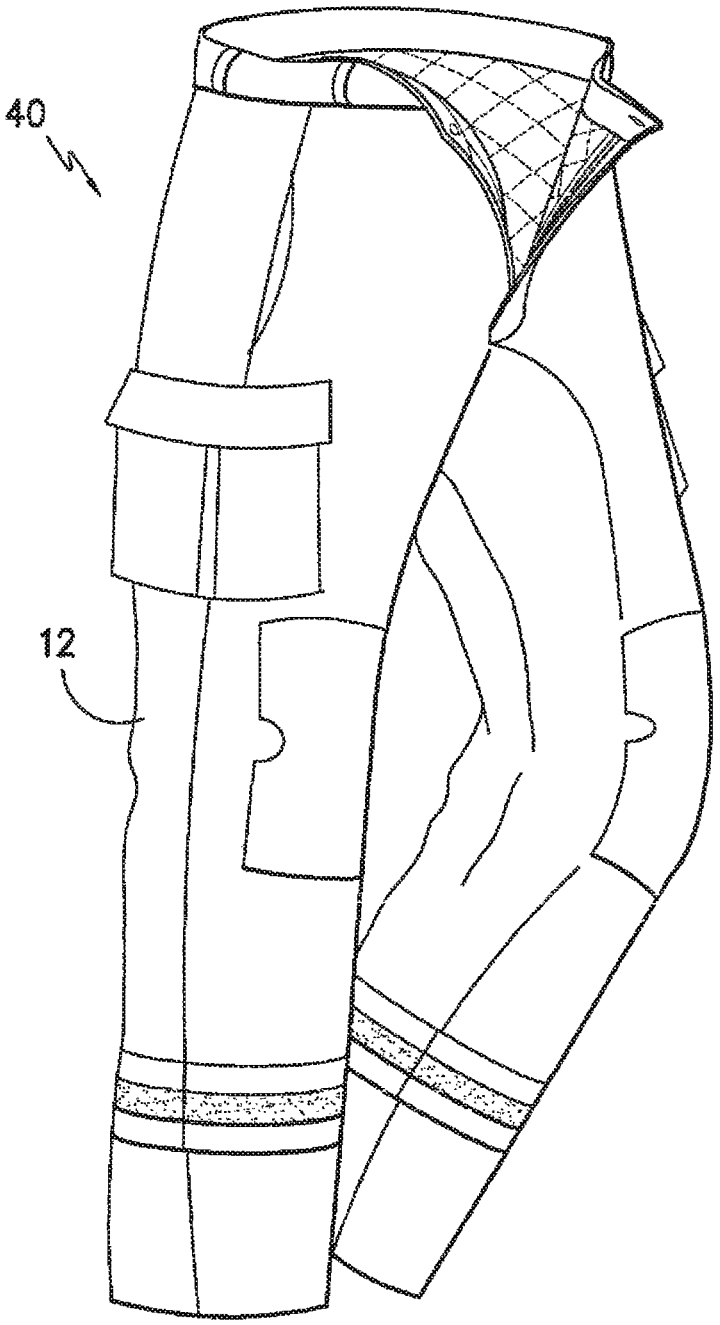
FIG. 3 is a perspective view of one embodiment of trousers made in accordance with the present disclosure.
Figure 4:
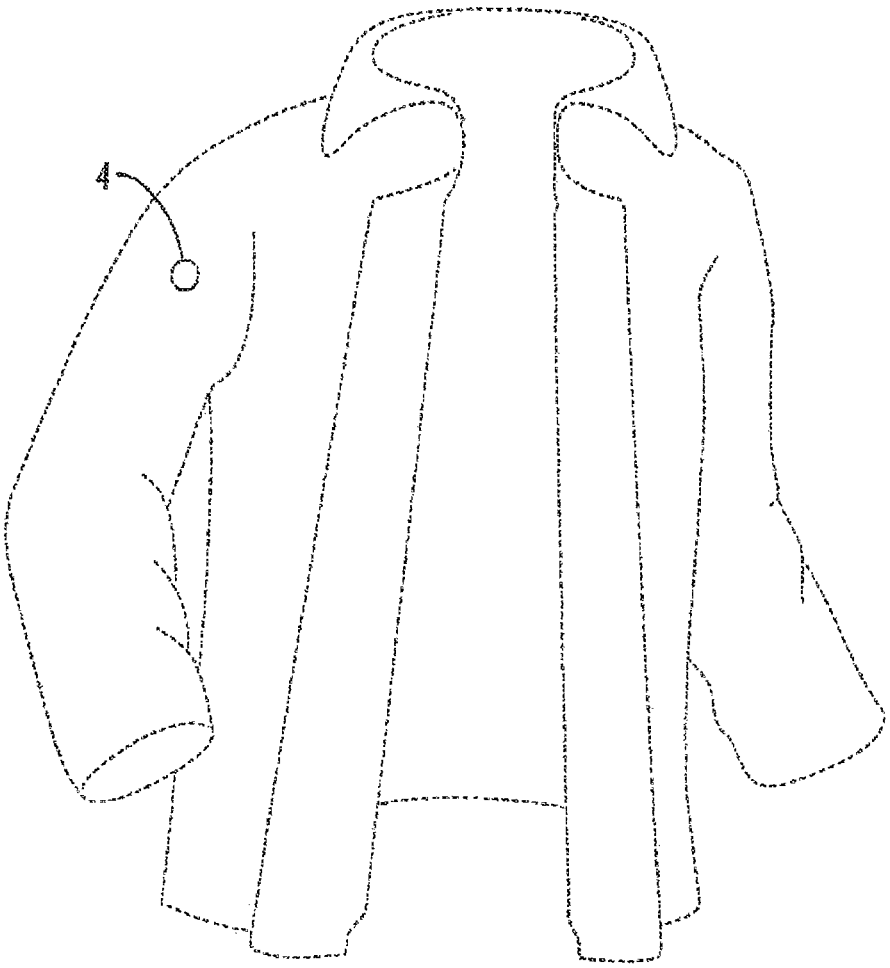
FIG. 4 is a front perspective view of a first embodiment of a coat showing a design as embodied by a fabric used to construct the coat.
Figure 5:
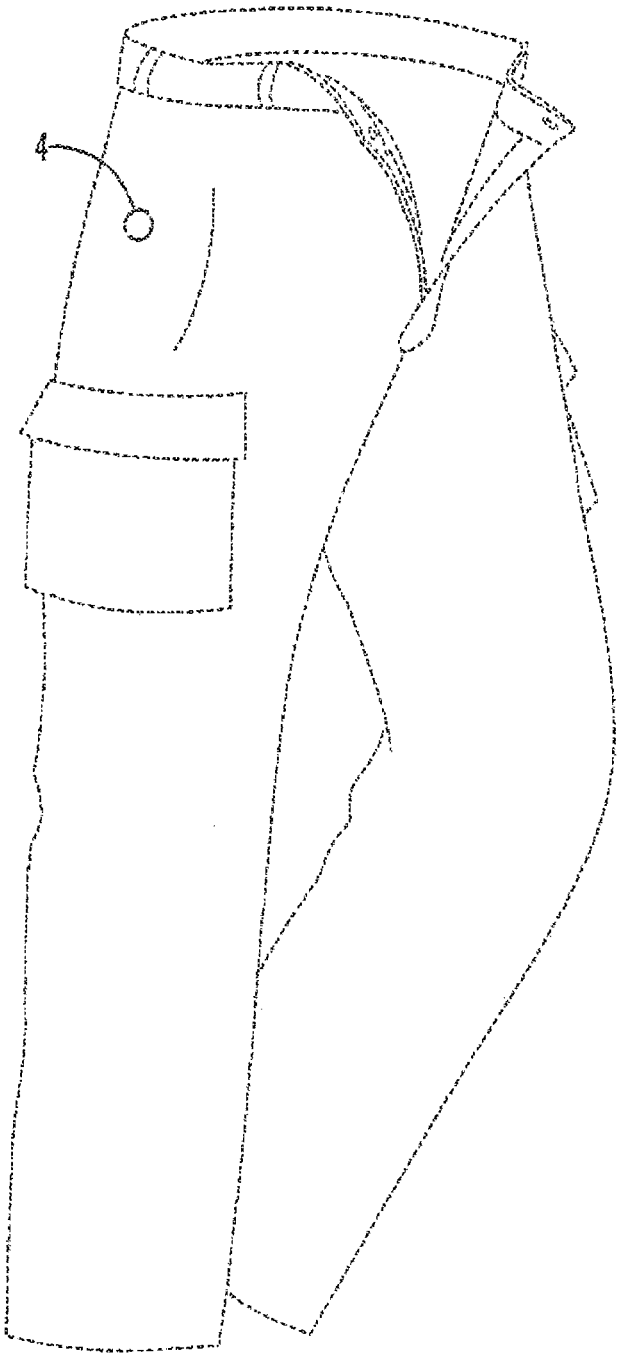
FIG. 5 is a front perspective view of a first embodiment of trousers showing the design illustrated in FIG. 4.
Figure 6:
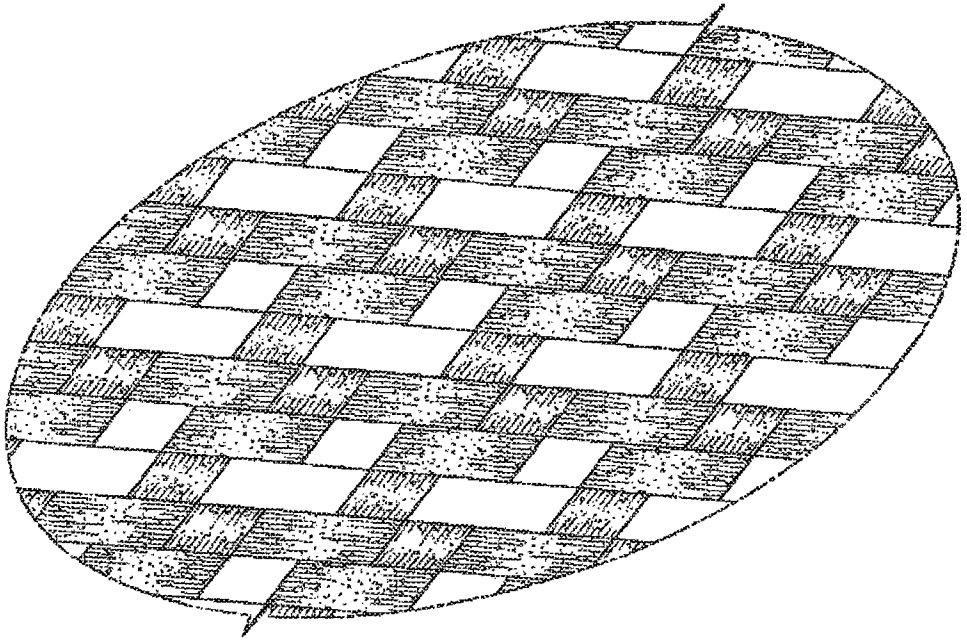
FIG. 6 is a plan view of one side of a fabric that embodies the design as illustrated in FIGS. 4 and 5.
Figure 7:
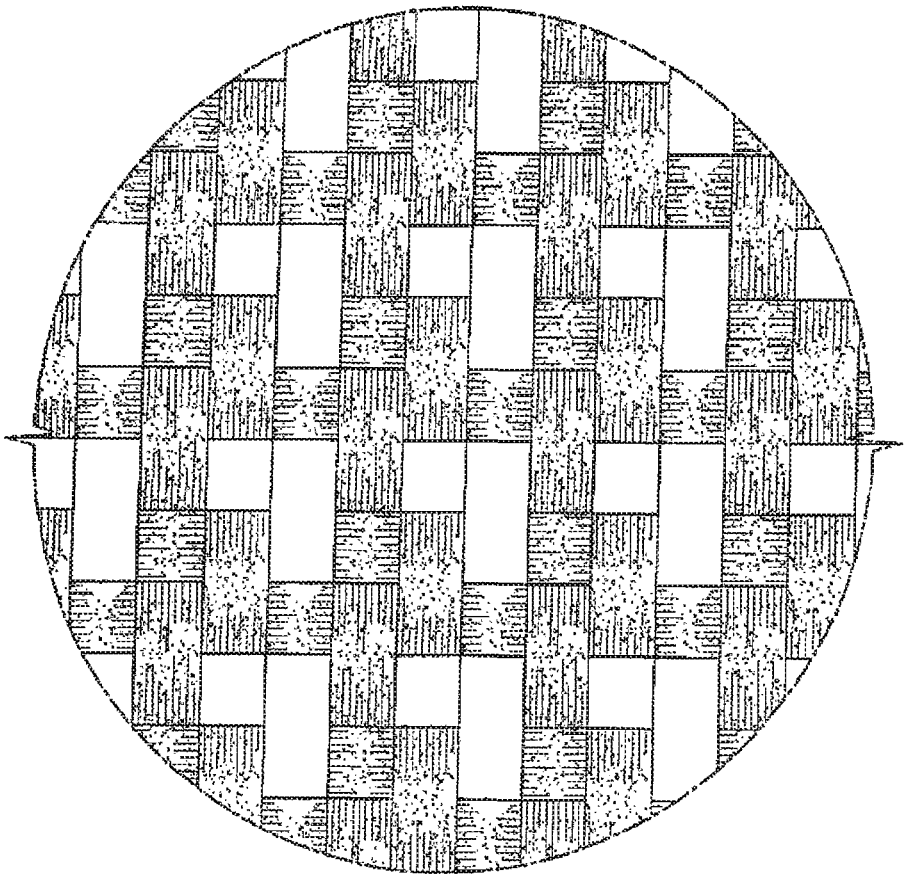
FIG. 7 is a plan view of an opposite side of a fabric that embodies the design illustrated in FIGS. 4 and 5.
Figure 8:
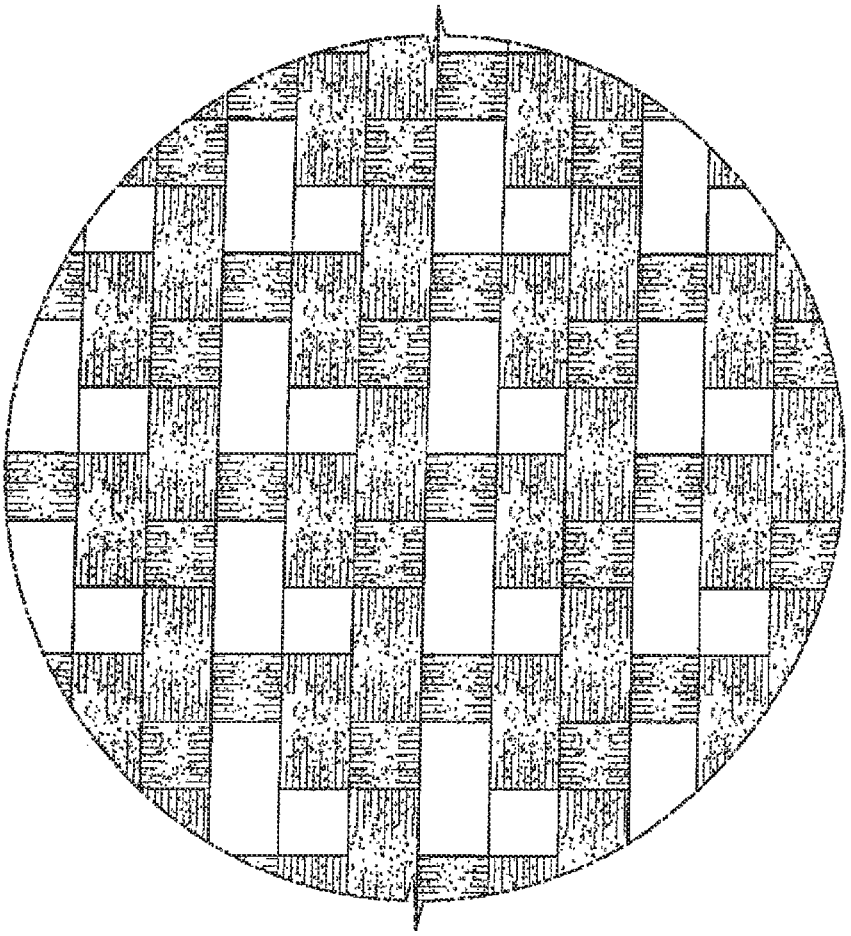
FIG. 8 is a plan view of an opposite side of the fabric that embodies the design illustrated in FIGS. 4 and 5.

Referring to FIG. 3, a pair of trousers made in accordance with the present disclosure is shown. The trousers 40 as shown in FIG. 3 can be used in conjunction with the turnout coat 10 illustrated in FIG. 1. The trousers 40 also include an outer shell 12 made from the fabric of the present disclosure.

In accordance with the present disclosure, the outer shell 12 is made from a fabric containing filament yarns and spun yarns. The filament yarns and spun yarns are made from fire resistant materials, such as inherently flame resistant fibers. As will be described in greater detail below, the spun yarns and filament yarns are constructed from materials and woven together in a manner that produces a fabric having excellent thermal and physical properties at relatively low basis weights. Of particular advantage, the fabric also has a soft hand, meaning that the fabric is flexible and therefore comfortable to wear.

In one embodiment, for instance, the fabric used to produce the outer shell 12 of the garment 10 may include a plurality of warp yarns interwoven with a plurality of fill yarns. In accordance with the present disclosure, at least certain of the warp yarns are filament yarns and at least certain of the fill yarns are filament yarns. The remaining yarns in the fabric, on the other hand, may comprise spun yarns.

In one embodiment, the filament yarns may be made from an inherently flame resistant material. For example, the filament yarns may be made from an aramid filament, such as a para-aramid filament. The use of a para-aramid filament yarn increases the strength of the fabric while also providing excellent flame resistant properties.

In other embodiments, the filament yarns may be made from other flame resistant materials. For instance, the filament yarns may be made from poly-p-phenylenebenzobisoxazole fibers (PBO fibers), and/or FR cellulose fibers, such as FR viscose filament fibers.

The filament yarns are combined with spun yarns. In accordance with the present disclosure, the spun yarns, in one embodiment, may contain polybenzimidazole fibers alone or in combination with other fibers. For example, in one embodiment, the spun yarns may contain polybenzimidazole fibers in combination with aramid fibers, such as para-aramid fibers, meta-aramid fibers, or mixtures thereof.

Instead of or in addition to containing polybenzimidazole fibers, the spun yarns may contain aramid fibers as described above, modacrylic fibers, preoxidized carbon fibers, melamine fibers, polyamide imide fibers, polyimide fibers, and mixtures thereof.

In one particular embodiment, the spun yarns contain polybenzimidazole fibers in an amount greater than about 30% by weight, such as in an amount greater than about 40% by weight. The polybenzimidazole fibers may be present in the spun yarns in an amount less than about 60% by weight, such as in an amount less than about 55% by weight. The remainder of the fibers, on the other hand, may comprise para-aramid fibers.

In one embodiment, various other fibers may be present in the spun yarns. When the fabric is used to produce turnout coats for firemen, the spun yarns can be made exclusively from inherently flame resistant fibers. When the fabric is being used in other applications, however, various other fibers may be present in the spun yarns. For instance, the spun yarns may contain fibers treated with a fire retardant, such as FR cellulose fibers. Such fibers can include FR cotton, FR rayon, FR acetate, FR triacetate, and FR lyocell, and the like. The spun yarns may also contain nylon fibers if desired, such as antistatic fibers.

In accordance with the present disclosure, the filament yarns and the spun yarns are woven together such that the ratio of filament yarns to spun yarns can be from about 1:1 to about 1:5, such as greater than 1:1 to about 1:4. In one embodiment, for instance, the ratio between the filament yarns and the spun yarns can be from about 2:3 to about 1:3. In one particular embodiment, the fabric contains two spun yarns for each filament yarn.

Woven fabrics made in accordance with the present disclosure generally include a warp direction and a fill direction. The ratio of filament yarns to spun yarns in each direction of the fabric can be the same or different. For example, in one embodiment, a greater density of filament yarns may be present in the warp direction than the fill direction or a greater density of filament yarns may be present in the fill direction than the warp direction. In one embodiment, the spun yarns and filament yarns are present in the fabric such that the fabric contains polybenzimidazole fibers in an amount of at least about 20% by weight, such as in an amount of at least about 25% by weight, such as in an amount of at least about 30% by weight, such as in an amount of at least about 35% by weight, such as in an amount of at least about 40% by weight. In general, the polybenzimidazole fibers may be present in the fabric in an overall amount of less than about 70% by weight, such as less than about 60% by weight, such as less than about 50% by weight.

In general, various different weave patterns may be used to produce the fabric. For instance, a twill weave, a plain weave, a rip stop weave, or a herringbone weave may be used. In one particular embodiment, the fabric may have a twill weave. The twill weave may have a 2×1 or a 3×1 weave. In a twill weave, crossings of adjacent warps occur along diagonal twill lines. In a 2×1 twill weave, the warp yarns pass over two fill yarns before interlacing with a third yarn. The interlacings are offset along a diagonal to produce characteristic twill lines.

The sizes of the yarns and the basis weight of the fabric can vary depending upon the particular application and the desired results. As used herein, the size of a yarn refers to its weight per unit length. For filament yarns, size is measured in denier, while for spun yarns size is measured as yarn count. As used herein, a larger sized yarn is generally coarser while a smaller sized yarn is finer. In general, the filament yarns can have a denier of greater than about 100, such as greater than about 200. The denier is generally less than about 1000, such as less than about 900. The spun yarn, on the other hand, can have a count or size of generally greater (more coarse) than about 108/2, such as greater than 70/2 and can have a count of less than (finer) about 14/2, such as less than about 18/2.

In one embodiment, the size of the filament yarns may be greater than the size of the spun yarns. In fact, various advantages and benefits may be obtained by having the size of the filament yarn larger than the size of the spun yarn. Increasing the size of the filament yarn, for instance, may dramatically increase the strength of the fabric. The manner in which the yarns are woven together, however, prevents the filament yarns from creating issues with snagging or abrasion resistance.

For example, when the filament yarns have a denier of 800, the spun yarns can have a size or count of 14/2 or finer. When the filament yarns have a denier of 600, the spun yarns can have a count of 18/2 or finer, such as 20/2 or finer. When the filament yarns have a denier of 400, the spun yarns can have a count of about 27/2 or finer, such as about 32/2 or finer. When the filament yarns have a denier of 200, on the other hand, the spun yarns can have a count of about 54/2 or finer. When the filament yarns have a denier of about 100, the spun yarns can have a count of about 108/2 or finer.

In one embodiment, the filament yarns can have a denier of from about 200 to 600, while the spun yarns can have a count of from about 54/2 to about 14/2.

Although various benefits may be obtained by having the size of the filament yarn be larger than the size of the spun yarn, in other embodiments, there may be advantages to having the spun yarn be larger in size than the filament yarn.

The basis weight of fabrics made according to the present disclosure can vary depending upon various factors and the end use application. Of particular advantage, fabrics made according to the present disclosure can have excellent properties at relatively lighter basis weights. In general, the fabric can have a basis weight of from about 2 osy to about 9 osy, such as from about 4 osy to about 8 osy. In one embodiment, the basis weight can be less than about 7 osy, such as less than about 7.5 osy. In particular, it was discovered that fabrics made according to the present disclosure can have a basis weight of from about 6 osy to about 6.9 osy, while still having many of the physical properties of conventional fabrics having a basis weight of about 7.5 osy or greater.

Once the fabric is constructed, the fabric may be treated with various coatings and finishes as may be desired. In one embodiment, for instance, the fabric may be treated with a durable water resistant treatment. The durable water resistant treatment may comprise, for instance, a fluoropolymer. Other treatments that may be applied to the fabric include insect repellants and/or a moisture management finish.

Many different types of durable water resistant treatments may be applied to the fabric. In one embodiment, the durable water resistant treatment forms a finish (as opposed to a coating) on the fabric. The durable water resistant treatment can be applied to the fabric by treating the fabric with a bath containing the treatment, padding the composition into the fabric, placing the fabric on a tenter frame, and heating the fabric in order to evaporate all volatiles. During the process, the durable water resistant treatment may be applied to the fabric in an amount from about 0.5% to about 10% by weight, such as from about 1% to about 5% by weight.

In many applications, the durable water resistant treatment may comprise a fluoropolymer. Particular durable water resistant treatments that may be applied to the fabric in accordance with the present disclosure are discussed in greater detail below.

In one embodiment, the DWR comprises at least one member selected from the group consisting of a perfluoroalkyl group-containing substance, a fluorine-containing surfactant, a fluorine-containing oil, a fluorosilicone oil and a silicone oil. Preferably the fluorine-containing resin derives from an aqueous dispersion or dissolving in a solvent. Preferably, the fluorine-containing resin comprises a fluororesin or a mixture of a fluororesin and some other resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride.

In another embodiment, a durable water/soil-resistant fluoropolymer is selected from those groups that will provide the necessary water/soil resistance and can be polymerized. Examples include fluorinated monomers of acrylates, methacrylates, alkenes, alkenyl ethers, styrenes, and the like. Monomers that contain carbon-fluorine bonds that are useful include, but are not limited to, Zonyl TA-N (an acrylate from DuPont), Zonyl TM (a methacrylate from DuPont), FX-13 (an acrylate from 3M), and FX-14 (a methacrylate from 3M) or UNIDYNE TG581 (a $C_6$ fluoropolymer available from Daikin). The fluoropolymers may include —CF3 and —CHF2 end groups, perfluoroisopropoxy groups (—OCF(CF3)2), 3,3,3-trifluoropropyl groups, and the like. The polymers may include vinyl ethers having perfluorinated or partially fluorinated alkyl chains. The fluoropolymer preferably comprises one or more fluoroaliphatic radical-containing monomers. Monomers used to form the fluoropolymer may be based upon 6 carbon chain chemistry or 8 carbon chain chemistry.

In another embodiment, the DWR comprises a repellent and a fluorine-containing resin, wherein the repellent comprises an esterification reaction product (I-3) from a perfluoroalkyl group-containing compound (I-3-1) and a compound (I-3-2) containing a phosphoric acid group as a functional group, and the fluorine-containing resin derives from an aqueous dispersion. Preferably, the fluorine-containing resin comprises a fluororesin or a mixture of a fluororesin and some other resin. Preferably, the other resin is an acrylic resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride. Preferably, the fluorine-containing resin comprises a fluororesin obtained by seed polymerization of an acrylic resin.

Commercially available DWR not mentioned above that may be used in the present disclosure include fluoropolymer compositions sold under the name MILEASE® by Clariant, fluorochemicals sold under the tradename TEFLON® or Capstone® by DuPont, fluorochemicals sold under the by tradename ZEPEL® also by DuPont, or fluorocarbon polymers sold under the tradename REPEARL® by the Mitsubishi Chemical Company or fluorocarbon polymers sold under the tradename UNIDYNE® by the Daikin Company.

In one embodiment, if desired, an isocyanate may be present in conjunction with a fluorochemical, such as a fluoropolymer. The isocyanate may comprise a blocked isocyanate that is a formaldehyde-free cross-linking agent for fluorochemical finishes. The blocking agent may comprise a phenol or any other suitable constituent.

Once treated with a durable water resistant treatment, the fabric may have a spray rating of at least 70, such as at least 80, such as even greater than 90 after 5 laundry cycles, after 10 laundry cycles, after 20 laundry cycles, and even after 30 laundry cycles. The spray rating of a fabric is determined according to AATCC 22 and is described in U.S. Pat. No. 7,581,260.

Fabrics made according to the present disclosure can have excellent tensile strength properties. For instance, the fabric can have a break strength according to ASTM D5034 in the fill direction of greater than about 400 lbs., such as greater than about 450 lbs., such as greater than about 550 lbs., such as greater than about 600 lbs., such as greater than about 620 lbs. at a fabric weight of from about 5 osy to about 8 osy, and particularly from about 7 osy to about 7.5 osy. The break strength in the warp direction can generally be greater than about 400 lbs., such as greater than about 500 lbs., such as greater than about 550 lbs. The break strength is generally less than about 800 lbs.

The fabric can display a trap tear according to ASTM Test D5587 of greater than about 200 lbs., such as greater than about 250 lbs., such as greater than about 275 lbs., such as greater than about 290 lbs. in the fill direction. In the warp direction, the trap tear can be generally greater than about 200 lbs., such as greater than about 250 lbs., such as greater than about 300 lbs., such as greater than about 325 lbs., such as greater than about 335 lbs. The trap tear in the fill direction and in the warp direction is generally less than about 500 lbs. at the basis weights described above with respect to the break strength.

The fabric can have the above strength properties while being very flexible. For instance, when tested according to the circular bend test according to ASTM Test D4032, the fabric can have a circular bend in the fill direction of less than about 6 lbs., such as less than about 5.5 lbs., such as less than about 5 lbs., such as even less than about 4.5 lbs., especially for a fabric having a weight of from about 6.5 osy to about 7 osy. In the warp direction, the circular bend can generally be less than about 5 lbs., such as less than about 4.5 lbs., such as less than about 4 lbs., such as even less than about 3.5 lbs. In general, the circular bend is greater than about 1 lb. in both the fill direction and warp direction.

On a weight basis, fabrics made according to the present invention can have a break strength in the fill direction or in the warp direction of greater than about 60 lbs. per osy, such as greater than about 65 lbs. per osy, such as greater than about 70 lbs. per osy, such as greater than about 75 lbs. per osy, such as even greater than about 80 lbs. per osy. The break strength per weight is generally less than about 120 lbs. per osy. The trap tear in the fill direction or the warp direction can generally be greater than about 40 lbs. per osy, such as greater than about 42 lbs. per osy, such as greater than about 46 lbs. per osy. The trap tear per weight is generally less than about 70 lbs. per osy.

The fabric of the present disclosure also possesses excellent thermal properties. For instance, when tested according to ASTM Test D6413, the fabric can have a char length in both the fill and warp direction of less than about 10 mm, such as less than about 9 mm, such as even less than about 8 mm. The char length is generally greater than about 1 mm.

In addition to having excellent mechanical properties and fire resistant properties, fabrics made in accordance with the present disclosure may also display a new, original and ornamental design. For instance, one embodiment of a design in accordance with the present disclosure is illustrated in FIGS. 4-8.

The present disclosure may be better understood with reference to the following examples.

Example No. 1

The following fabrics were produced and tested for various properties. Sample Nos. 1 and 2 described below represent previously made fabrics including a grid-like pattern. Sample Nos. 3 and 4, on the other hand, were made in accordance with the present disclosure. As shown below, a fabric made in accordance with the present disclosure demonstrated not only excellent strength characteristics and flexibility characteristics but also possessed excellent flame resistance.

Sample No. 1

This fabric contained spun yarns and filament yarns in a plain weave. The filament yarns formed a grid-like pattern in the fabric.

Warp Yarn: 21/2 Spun yarn containing 40% polybenzimidazole fibers and 60% para-aramid fibers. The second warp yarn was a 600 denier multi-filament yarn containing para-aramid fibers. The filament yarn accounted for every tenth yarn in the warp direction.

Fill Yarn: 21/2 Spun yarn containing 40% polybenzimidazole fibers and 60% para-aramid fibers. The second fill yarn was a 600 denier multi-filament yarn containing para-aramid fibers. The filament yarn accounted for every tenth yarn in the fill direction.

Ends: 51 per inch
Picks: 51 per inch
Weight: 7.39 osy
Weave: Plain weave

Sample No. 2

This fabric contained spun yarns and filament yarns in a plain weave. The filament yarns formed a grid-like pattern in the fabric.

Warp Yarn: 21/2 Spun yarn containing 40% polybenzimidazole fibers and 60% para-aramid fibers. The second warp yarn was a 600 denier multi-filament yarn containing para-aramid fibers. The filament yarn accounted for every seventh yarn in the warp direction.

Fill Yarn: 21/2 Spun yarn containing 40% polybenzimidazole fibers and 60% para-aramid fibers. The second fill yarn was a 600 denier multi-filament yarn containing para-aramid fibers. The filament yarn accounted for every seventh yarn in the fill direction.

Ends: 51 per inch
Picks: 51 per inch
Weight: 7.58 osy
Weave: Plain weave

Sample No. 3

The below fabric included spun yarns and filament yarns in both the warp direction and the fill direction. The weave pattern included two spun yarns, one filament yarn, two spun yarns, one filament yarn, etc. in both the fill direction and the warp direction.

Warp Yarn: 18/2 Spun yarn containing 61.6% para-aramid fibers and 38.4% meta-aramid fibers. The filament yarn was a 600 denier filament yarn containing para-aramid fibers.

Fill Yarn: 18/2 Spun yarn containing 61.6% para-aramid fibers and 38.4% meta-aramid fibers. The filament yarn was a 600 denier filament yarn containing para-aramid fibers.

Ends: 48 per inch
Picks: 42 per inch
Weight: 7.12 osy
Weave: 2×1 twill weave

Sample No. 4

The below fabric included spun yarns and filament yarns in both the warp direction and the fill direction. The weave pattern included two spun yarns, one filament yarn, two spun yarns, one filament yarn, etc. in both the fill direction and the warp direction.

Warp Yarn: 26/3 spun yarn containing 55% para-aramid fibers and 45% polybenzimidazole fibers. The filament yarn was a 600 denier filament yarn containing para-aramid fibers.

Fill Yarn: 26/3 spun yarn containing 55% para-aramid fibers and 45% polybenzimidazole fibers. The filament yarn was a 600 denier filament yarn containing para-aramid fibers.

Ends: 46 per inch
Picks: 41 per inch
Weight: 7.21 osy
Weave: 2×1 twill weave

Sample No. 5

The below fabric included spun yarns and filament yarns in both the warp direction and the fill direction. The weave pattern included two spun yarns, one filament yarn, two spun yarns, one filament yarn, etc. in both the fill direction and the warp direction.

Warp Yarn: 18/2 spun yarn containing 48% para-aramid fibers and 52% polybenzimidazole fibers. The filament yarn was a 600 denier filament yarn containing para-aramid fibers.

Fill Yarn: 18/2 spun yarn containing 48% para-aramid fibers and 52% polybenzimidazole fibers. The filament yarn was a 600 denier filament yarn containing para-aramid fibers.

Ends: 43 per inch
Picks: 43 per inch
Weight: 7.00 osy
Weave: 2×1 twill weave

| TEST_METHOD | TEST_NAME | UNIT | Sample 1 | Sample 2 | Sample 3 | Sample 4 | Sample 5 |
|---|---|---|---|---|---|---|---|
| AATCC 118 | OIL REPELLENCY | AATCC SCALE | 6 | 6 | 6 | 6 | 6 |
| AATCC 135 | SHRINK FILL 5X | PERCENT | 3.1 | 2.1 | 0.0 | 0.8 | 0.1 |
| | SHRINK WARP 5X | PERCENT | 1.7 | 1.0 | 2.8 | 2.0 | 0.2 |
| AATCC 193 | WATER REPELLENCY | AATCC SCALE | 6 | 6 | 6 | 6 | 6 |
| AATCC 22 | SPRAY RATING | AATCC SCALE | 100 | 100 | 100 | 100 | 100 |
| AATCC 42 | WATER ABSORPTION | PERCENT | 0.2 | 0.3 | 0.6 | 0.9 | 1.0 |
| AATCC 42 (AATCC 135) | WATER ABSORPTION 5X | PERCENT | 0.8 | 0.4 | 0.0 | 1.6 | 1.8 |
| ASTM D 1777 | THICKNESS | INCHES | 0.015 | 0.017 | 0.016 | 0.018 | 0.017 |
| ASTM D 3774 | WIDTH | INCHES | 61.15 | 61.01 | 61.25 | 60.25 | 61.00 |
| ASTM D 3775 | ENDS | THRDS_IN | 51 | 51 | 49 | 46 | 43 |
| | PICKS | THRDS_IN | 52 | 50 | 45 | 40 | 43 |
| ASTM D 3776 | WEIGHT | OZ_SQ_YD | 7.39 | 7.58 | 7.12 | 7.21 | 7.00 |
| ASTM D 4032 | CIRCULAR BEND FILL | POUNDS | 6.4 | 6.9 | 5.7 | 4.2 | 3.1 |
| | CIRCULAR BEND WARP | POUNDS | 6.1 | 6.0 | 5.4 | 3.3 | 3.1 |
| ASTM D 5034 | BREAK STRENGTH FILL | POUNDS | 356 | 417 | 636 | 623 | 468 |
| | BREAK STRENGTH WARP | POUNDS | 275 | 335 | 615 | 588 | 456 |
| ASTM D 5034 (AATCC 135) | BREAK STRENGTH FILL 5X | POUNDS | 296 | 335 | 529 | 552 | 498 |
| | BREAK STRENGTH WARP 5X | POUNDS | 252 | 282 | 592 | 521 | 466 |
| ASTM D 5587 | TRAP TEAR FILL | POUNDS | 123 | 277 | 205 | 296 | 313 |
| | TRAP TEAR WARP | POUNDS | 121 | 167 | 282 | 341 | 219 |
| ASTM D 5587 (AATCC 135) | TRAP TEAR FILL 5X | POUNDS | 70 | 113 | | 231 | 218 |
| | TRAP TEAR WARP 5X | POUNDS | 90 | 109 | | 322 | 213 |
| ASTM D 6413 | AFTER FLAME FILL | SECONDS | 0 | 0 | 0 | 0 | 0 |
| | AFTER FLAME WARP | SECONDS | 0 | 0 | 0 | 0 | 0 |
| | AFTER GLOW FILL | SECONDS | 5 | 7 | 8 | 5 | 3 |
| | AFTER GLOW WARP | SECONDS | 5 | 7 | 8 | 5 | 4 |
| | CHAR LENGTH FILL | MM | 16 | 16 | 13 | 8 | 9 |
| | CHAR LENGTH WARP | MM | 15 | 16 | 12 | 6 | 10 |
| | DRIP FILL | NONE | 0 | 0 | 0 | 0 | 0 |
| | DRIP WARP | NONE | 0 | 0 | 0 | 0 | 0 |
| ASTM D 6413 (AATCC 135) | AFTER FLAME FILL 5X | SECONDS | 0 | 0 | 0 | 0 | 0 |
| | AFTER FLAME WARP 5X | SECONDS | 0 | 0 | 0 | 0 | 0 |
| | AFTER GLOW FILL 5X | SECONDS | 8 | 9 | 10 | 9 | 5 |
| | AFTER GLOW WARP 5X | SECONDS | 9 | 9 | 11 | 10 | 6 |
| | CHAR LENGTH FILL 5X | MM | 14 | 16 | 15 | 8 | 9 |
| | CHAR LENGTH WARP 5X | MM | 14 | 18 | 15 | 7 | 9 |
| | DRIP FILL 5X | NONE | 0 | 0 | 0 | 0 | 0 |
| | DRIP WARP 5X | NONE | 0 | 0 | 0 | 0 | 0 |
| NFPA 1971 8.6 | SHRINK FILL 5 MN 500 F | PERCENT | 0.1 | 0.2 | 0.0 | 0.0 | 0.5 |
| | SHRINK WARP 5 MN 500 F | PERCENT | 0.1 | 0.1 | 0.5 | 0.0 | 1.0 |
| NFPA 1971 8.6 (AATCC 135) | SHRINK FILL 5 MN 500 F 5X | PERCENT | 0.8 | 0.2 | 0.0 | 0.5 | 0.5 |
| | SHRINK WARP 5 MN 500 F 5X | PERCENT | 0.7 | 0.1 | 0.0 | 0.0 | 0.8 |

Example No. 2

The following fabrics were also produced and tested. In the following example, both fabrics had a weight of about 6 osy.

Sample No. 1

This fabric contained spun yarns and filament yarns in a plain weave. The filament yarns formed a grid-like pattern in the fabric.

Warp Yarn: 21/2 Spun yarn containing 40% polybenzimidazole fibers, 58% para-aramid and 2% Antistat fibers. The second warp yarn was a 400 denier multi-filament yarn containing para-aramid fibers. The filament yarn accounted for every eighth yarn in the warp direction.

Fill Yarn: 21/2 Spun yarn containing 40% polybenzimidazole fibers, 58% para-aramid and 2% Antistat fibers. The second fill yarn was a 400 denier multi-filament yarn containing para-aramid fibers. The filament yarn accounted for every eighth yarn in the fill direction.

Ends: 44 per inch

Picks: 44 per inch

Weight: 5.80 osy

Weave: Plain weave

Sample No. 2

The below fabric included spun yarns and filament yarns in both the warp direction and the fill direction. The weave pattern included two spun yarns, one filament yarn, two spun yarns, one filament yarn, etc. in both the fill direction and the warp direction.

Warp Yarn: 30/2 spun yarn containing 49% para-aramid fibers, 49% polybenzimidazole and 2% Antistat fibers. The filament yarn was a 400 denier filament yarn containing para-aramid fibers.

Fill Yarn: 30/2 spun yarn containing 49% para-aramid fibers, 49% polybenzimidazole and 2% Antistat fibers. The filament yarn was a 400 denier filament yarn containing para-aramid fibers.

Ends: 60 per inch

Picks: 60 per inch

Weight: 5.92 osy

Weave: 2×1 twill weave

| TEST_METHOD | TEST_NAME | UNIT | Sample 1 | Sample 2 |
|---|---|---|---|---|
| AATCC 118 | OIL REPELLENCY | AATCC SCALE | 6 | 5 |
| AATCC 135 | SHRINK FILL 5X | PERCENT | 0.0 | 0.0 |
| | SHRINK WARP 5X | PERCENT | 2.5 | 1.0 |
| AATCC 193 | WATER REPELLENCY | AATCC SCALE | 6 | 6 |
| AATCC 22 | SPRAY RATING | AATCC SCALE | 100 | 100 |
| AATCC 42 | WATER ABSORPTION | PERCENT | 1.0 | 0.4 |
| AATCC 42 (AATCC 135) | WATER ABSORPTION 5X | PERCENT | 0.5 | 0.0 |
| ASTM D 1777 | THICKNESS | INCHES | 0.014 | 0.015 |
| ASTM D 3774 | WIDTH | INCHES | 59.75 | 61.00 |
| ASTM D 3775 | ENDS | THRDS_IN | 44 | 60 |
| | PICKS | THRDS_IN | 44 | 60 |
| ASTM D 3776 | WEIGHT | OZ_SQ_YD | 5.80 | 5.92 |
| ASTM D 4032 | CIRCULAR BEND FILL | POUNDS | 2.6 | 2.6 |
| | CIRCULAR BEND WARP | POUNDS | 2.4 | 3.3 |
| ASTM D 5034 | BREAK STRENGTH FILL | POUNDS | 256 | 396 |
| | BREAK STRENGTH WARP | POUNDS | 251 | 394 |
| ASTM D 5034 (AATCC 135) | BREAK STRENGTH FILL 5X | POUNDS | 245 | 468 |
| | BREAK STRENGTH WARP 5X | POUNDS | 219 | 448 |
| ASTM D 5587 | TRAP TEAR FILL | POUNDS | 95 | 292 |
| | TRAP TEAR WARP | POUNDS | 60 | 314 |
| ASTM D 5587 (AATCC 135) | TRAP TEAR FILL 5X | POUNDS | 54 | 335 |
| | TRAP TEAR WARP 5X | POUNDS | 52 | 325 |
| ASTM D 6413 | AFTER FLAME FILL | SECONDS | 0 | 0 |
| | AFTER FLAME WARP | SECONDS | 0 | 0 |
| | AFTER GLOW FILL | SECONDS | 6 | 6 |
| | AFTER GLOW WARP | SECONDS | 5 | 6 |
| | CHAR LENGTH FILL | MM | 19 | 14 |
| | CHAR LENGTH WARP | MM | 23 | 15 |
| | DRIP FILL | NONE | 0 | 0 |
| | DRIP WARP | NONE | 0 | 0 |
| ASTM D 6413 (AATCC 135) | AFTER FLAME FILL 5X | SECONDS | 0 | 0 |
| | AFTER FLAME WARP 5X | SECONDS | 0 | 0 |
| | AFTER GLOW FILL 5X | SECONDS | 7 | 7 |
| | AFTER GLOW WARP 5X | SECONDS | 7 | 7 |
| | CHAR LENGTH FILL 5X | MM | 19 | 13 |
| | CHAR LENGTH WARP 5X | MM | 17 | 12 |
| | DRIP FILL 5X | NONE | 0 | 0 |
| | DRIP WARP 5X | NONE | 0 | 0 |
| NFPA 1971 8.6 | SHRINK FILL 5 MN 500 F | PERCENT | 0.0 | 0.0 |
| | SHRINK WARP 5 MN 500 F | PERCENT | 0.7 | 0.0 |
| NFPA 1971 8.6 (AATCC 135) | SHRINK FILL 5 MN 500 F 5X | PERCENT | 1.3 | 0.5 |
| | SHRINK WARP 5 MN 500 F 5X | PERCENT | 1.3 | 0.5 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A flame resistant garment comprising:

a fabric shaped to cover at least a portion of a wearer's body, the fabric comprising first yarns combined with second yarns, the first yarns being made primarily from para-aramid fibers, the second yarns comprising spun yarns, the second yarns being made exclusively of inherently flame resistant fibers, and wherein the fabric includes a warp direction and a fill direction and wherein the first yarns and the second yarns are positioned in the warp direction and in the fill direction, and wherein after each single first yarn is positioned greater than 1 and up to 4 spun yarns in both the warp direction and the fill direction.

2. A flame resistant garment as defined in claim 1, wherein the fabric is free of cellulose fibers treated with a fire retardant.

3. A flame resistant garment as defined in claim 1, wherein the first yarns are made exclusively from para-aramid fibers.

4. A flame resistant garment as defined in claim 1, wherein at least certain of the spun yarns include yarns comprised of polybenzimidazole fibers in combination with aramid fibers.

5. A flame resistant garment as defined in claim 1, wherein all of the spun yarns comprise polybenzimidazole fibers in combination with aramid fibers.

6. A flame resistant garment as defined in claim 1, wherein the fabric contains poly-p-phenylenebenzobisoxazole fibers.

7. A flame resistant garment as defined in claim 1, wherein the garment comprises a fireman turnout coat and the fabric comprises an outer shell of the garment.

8. A flame resistant garment as defined in claim 4, wherein after each single first yarn are positioned greater than 1 and up to 3 spun yarns in both the warp direction and the fill direction.

9. A flame resistant garment as defined in claim 1, wherein after each single first yarn in at least one of the warp direction or the fill direction is positioned two spun yarns.

10. A flame resistant garment as defined hi claim 1, wherein fibers present in the spun yarns are comprised of para-aramid fibers.

11. A flame resistant garment as defined in claim 4, wherein the spun yarns contained in the fabric contain polybenzimidazole fibers in an amount greater than 30% by weight.

12. A flame resistant garment as defined in claim 1, wherein the fabric has a twill weave.

13. A flame resistant garment as defined in claim 1, wherein the fabric contains polybenzimidazole fibers in an amount from 20% to 70% by weight.

14. A flame resistant garment as defined in claim 1, wherein the fabric has a basis weight of from 4 osy to 9 osy.

15. A flame resistant garment as defined in claim 14, wherein the fabric has a circular bend in either a warp direction or in a fill direction of from 2 lbs. to 5 lbs. when tested according to ASTM Test D4032.

16. A flame resistant garment as defined in claim 14, wherein the fabric has a break strength in a fill direction of from 400 lbs. to 800 lbs. and has a break strength in a warp direction of from 400 lbs. to 800 lbs. when tested according to ASTM Test D5034.

17. A flame resistant garment as defined in claim 14, wherein the fabric has a trap tear in a warp direction of from 200 lbs. to 500 lbs. and has a trap tear in a fill direction of from 200 lbs. to 500 lbs. when tested according to ASTM Test D5587.

18. A flame resistant garment as defined in claim 14, wherein the fabric exhibits a char length in a warp direction and in a fill direction of less than 10 mm when tested according to ASTM Test D6413.

19. A flame resistant garment as defined in claim 1, wherein the first yarns comprise para-aramid filament yarns.

20. A flame resistant garment as defined in claim 1, wherein the filament yarns comprise para-aramid filament yarns.

21. A flame resistant garment comprising:

a fireman turnout coat containing an outer shell fabric, the fabric shaped to cover at least a portion of a wearer's body, a fabric shaped to cover at least a portion of a wearer's body, the fabric comprising first yarns combined with second yarns, the first yarns being made primarily from para-aramid fibers, the second yarns comprising spun yarns, the second yarns being made exclusively of inherently flame resistant fibers, and wherein the fabric includes a warp direction and a fill direction and wherein the first yarns and the second yarns are positioned in the warp direction and in the fill direction, and wherein after each single first yarn is positioned greater than 1 and up to 4 spun yarns in both the warp direction and the fill direction wherein the fabric has a basis weight of from 4 osy to 9 osy, the fabric has a circular bend in either a warp direction or in a fill direction of from 2 pounds to 5 pounds when tested according to ASTM Test D-4032, the fabric has a break strength in the fill direction of from 400 pounds to 800 pounds when tested according to ASTM-Test D-5034, the fabric exhibits a trapezoidal Tear of from 250 pounds to 500 pounds in both the warp direction and the fill direction when tested according to ASTM Test D-5587, and the fabric exhibits a Char Length in the warp direction and in the fill direction of less than 10 mm when tested according to ASMT Test D-6413.

22. A flame resistant garment as defined in claim 21, wherein the spun yarns contained in the fabric contain polybenzimidazole fibers in an amount greater than 30% by weight, at least certain of the spun yarns comprising polybenzimidazole fibers in combination with aramid fibers.

23. A flame resistant garment comprising:

a fabric shaped to cover at least a portion of a wearer's body, the fabric comprising first yarns combined with second yarns, the first yarns comprising filament yarns, the filament yarns comprising a para-aramid, the second yarns comprising aramid fibers and melamine fibers, and wherein the fabric includes a warp direction and a fill direction; wherein the first yarns and the second yarns are positioned in the warp direction in a ratio from greater than 1:1 to about 1:4 and the first yarns and the second yarns are positioned in the fill direction in a ratio from greater than 1:1 to about 1:4.

24. A flame resistant garment as defined in claim 23, wherein the second yarns comprise para-aramid fibers, meta-aramid fibers, and melamine fibers.

25. A flame resistant garment as defined in claim 23, wherein the first yarns and the second yarns are positioned in the warp direction in a ratio from about 1:3 to about 2:3.

26. A flame resistant garment as defined in claim 23, wherein the first yarns and the second yarns are positioned in the warp direction in a ratio of 1:3 and the first yarns and the second yarns are positioned in the fill direction in a ratio of 1:4.

27. A flame resistant garment as defined in claim 23, wherein the first yarns have a yarn size from about 400 to about 800 denier.

28. A flame resistant garment as defined in claim 23, wherein the first yarns have a yarn size of 600 denier.

29. A flame resistant garment as defined in claim 23, wherein the fabric has a warp thread count of from about 43 to about 60 Ends per inch and a weft thread count of from about 41 to about 60 Picks per inch.

30. A flame resistant garment as defined in claim 23, wherein the fabric has a basis weight of from about 6 osy to about 9 osy.

* * * * *